US008009801B2

(12) United States Patent
Rospek et al.

(10) Patent No.: US 8,009,801 B2
(45) Date of Patent: Aug. 30, 2011

(54) PACKAGING SYSTEM FOR DETONATING CORDS FOR X-RAY EXAMINATION AND SAFE SHIPPING

(75) Inventors: Rolf Rospek, Edemissen (DE); Malte Veehmayer, Siegbürg (DE); Dimitri Riesen, Troisdorf (DE)

(73) Assignee: Dynaenergetics GmbH & Co. KG, Troisdorf (DE)

( * ) Notice: Subject to any disclaimer, the term of this patent is extended or adjusted under 35 U.S.C. 154(b) by 1029 days.

(21) Appl. No.: 10/554,245

(22) PCT Filed: Apr. 14, 2004

(86) PCT No.: PCT/EP2004/003907

§ 371 (c)(1),
(2), (4) Date: Jul. 28, 2006

(87) PCT Pub. No.: WO2004/097332

PCT Pub. Date: Nov. 11, 2004

(65) Prior Publication Data

US 2007/0170074 A1 Jul. 26, 2007

(30) Foreign Application Priority Data

Apr. 25, 2003 (DE) ..... 103 18 996
Mar. 26, 2004 (DE) ..... 10 2004 014 769

(51) Int. Cl.
*G01N 23/04* (2006.01)

(52) U.S. Cl. ..... 378/57; 378/58; 73/52; 206/3; 206/303; 206/388; 53/54

(58) Field of Classification Search ..... 206/3, 303, 206/388, 495, 524.8, 466; 378/57, 58; 73/52; 53/396, 54

See application file for complete search history.

(56) References Cited

U.S. PATENT DOCUMENTS 1,516,137 A * 11/1924 Bernstein ..... 206/388
2,393,221 A * 1/1946 Mercer et al. ..... 242/164
3,490,192 A * 1/1970 Regan, Jr. ..... 53/430
3,633,758 A * 1/1972 Morse et al. ..... 211/85.13
4,411,364 A * 10/1983 Friedman ..... 206/466
4,425,406 A * 1/1984 Palma ..... 428/12
4,586,602 A * 5/1986 Levey ..... 206/3

(Continued)

FOREIGN PATENT DOCUMENTS

DE 32 26 744 A1 3/1983

(Continued)

OTHER PUBLICATIONS

Automated Translation of DE 32 26 744 from European Patent Office, Mar. 23, 2010.*

*Primary Examiner* — David T Fidei
(74) *Attorney, Agent, or Firm* — Antonelli, Terry, Stout & Kraus, LLP.

(57) ABSTRACT

The invention relates to a packaging for a detonation cord (1) that is used especially for igniting shaped charge perforators in perforation guns utilized in the oil and natural gas industry. According to the invention, the detonation cord (1) is wound on one plane as a flat coil. Also disclosed is a method for examining whether a detonation cord (1) has faulty points. Said method is characterized in that the detonation cord (1) is subjected to an x-ray examination in the packaging before being delivered.

8 Claims, 2 Drawing Sheets

U.S. PATENT DOCUMENTS

| | | | | | |
|---|---|---|---|---|---|
| 4,688,674 | A | * | 8/1987 | Stirtz | 206/388 |
| 4,817,787 | A | * | 4/1989 | Owen | 206/3 |
| 5,005,694 | A | * | 4/1991 | Davis et al. | 206/3 |
| 5,007,230 | A | * | 4/1991 | Gaston | 53/397 |
| 5,114,662 | A | | 5/1992 | Gozani et al. | |
| 5,129,514 | A | | 7/1992 | Lilley, Jr. | |
| 5,526,928 | A | * | 6/1996 | Yabe et al. | 206/364 |
| 5,620,098 | A | * | 4/1997 | Boos et al. | 206/525 |
| 5,669,490 | A | * | 9/1997 | Colligan et al. | 206/63.3 |
| 5,695,456 | A | * | 12/1997 | Cartmell et al. | 602/43 |
| 5,704,473 | A | * | 1/1998 | Oster | 206/314 |
| 6,610,977 | B2 | * | 8/2003 | Megerle | 250/287 |
| 7,410,049 | B2 | * | 8/2008 | O'Brien et al. | 206/3 |

FOREIGN PATENT DOCUMENTS

| | | |
|---|---|---|
| EP | 0 382 615 B1 | 8/1990 |
| RU | 2 123 684 C1 | 12/1998 |
| WO | WO 99/00636 | 1/1999 |

* cited by examiner

PACKAGING SYSTEM FOR DETONATING CORDS FOR X-RAY EXAMINATION AND SAFE SHIPPING

BACKGROUND OF THE INVENTION

The invention relates to packaging for a detonating cord and a method of examining a detonating cord in its packaging.

Detonating cords are used to fire shaped charge perforators in perforating guns in the oil and natural gas industry. To ensure error-free initiation of charges, a defect-free detonating cord is needed. Incomplete detonation caused by inadequate filling of the detonating cord with explosive material may in particular lead to costly delays.

To enable these detonating cords to be shipped by sea, land or air, special packaging is required, the requirements for which are regulated by law. Packaging is described, for example in EP 0 382 615 B1, U.S. Pat. No. 4,586,602 or U.S. Pat. No. 4,817,787.

BRIEF SUMMARY OF THE INVENTION

The object of the invention is to provide packaging for detonating cords which meets legal requirements and to provide a method with which the detonating cord may be examined in its packaging for defects.

The method according to the invention is distinguished in that the detonating cord is subjected to X-ray examination in its packaging prior to shipping. An X-ray examination makes it easy to detect defects caused for example by inadequate filling with explosive material.

Packaging according to the invention is characterised in that the detonating cord is wound in a single plane as a flat spiral.

In an advantageous embodiment, the individual laps of the spiral are spaced from one another. The space is preferably filled with air or material, e.g. by spacers or by a spacing cord extending in parallel, wherein the thickness of the spacing cord corresponds to the necessary space.

The space between the laps ensures that, in the event of misfiring of the detonating cord, the adjacent lap is destroyed without crossover firing. Crossover firing means that the adjacent lap is ignited and the ignition process passed on to the remaining laps.

Advantageously, the last lap is passed perpendicularly over the flat-wound spiral.

In a preferred embodiment, the base plate of the packing consists of paperboard, wood or polystyrene.

The detonating cord is preferably sealed in a vacuum bag, which is attached to the base plate.

BRIEF DESCRIPTION OF THE DRAWINGS

The invention is explained in more detail below with reference to two Figures.

DETAILED DESCRIPTION OF THE INVENTION

Figure 2:
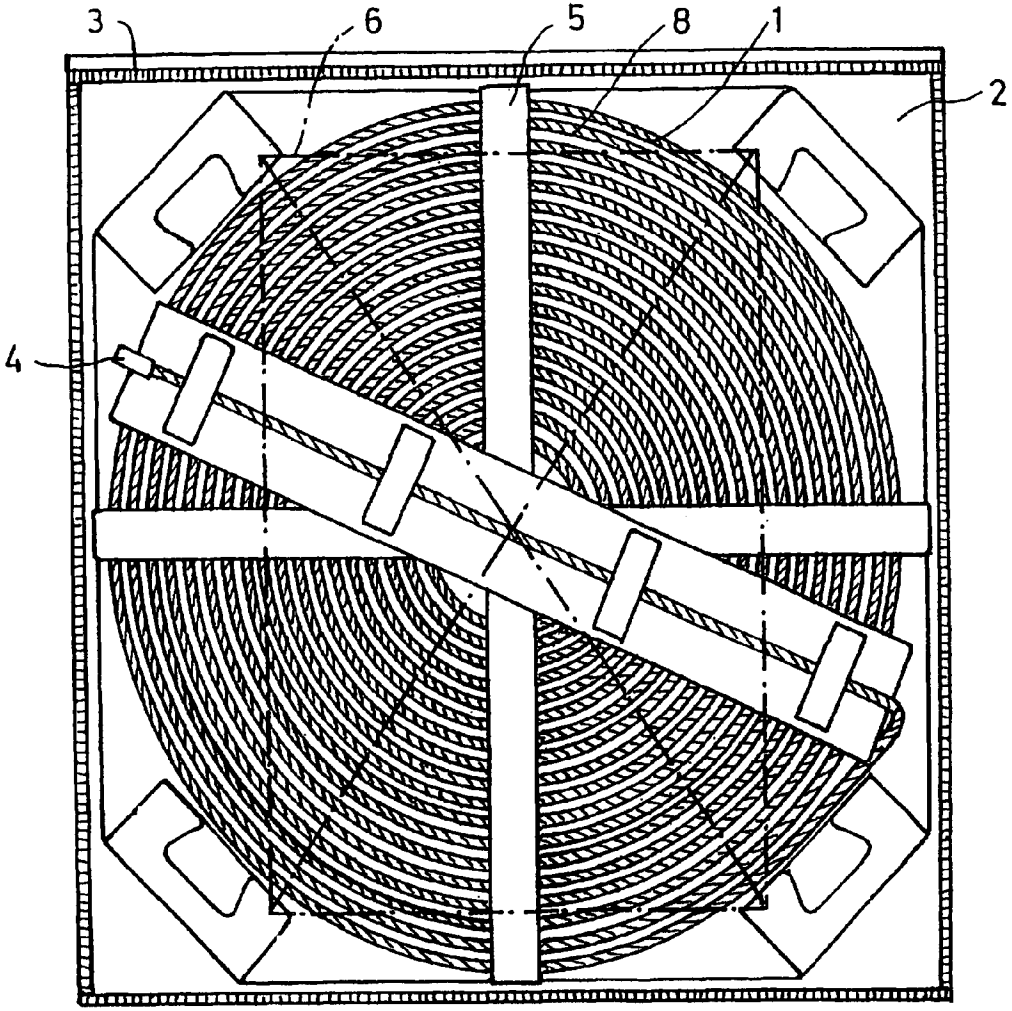
FIG. 2 shows a packaging system according to the invention for a detonating cord.

FIG. 2 shows a packaging system according to the invention for a detonating cord 1. The detonating cord 1 is wound as a flat spiral, the two ends being provided with an end cap 4. The base plate 2 of the packaging may consist, for example, of paperboard, wood or polystyrene. In the embodiment illustrated here, the detonating cord 1 is attached to the base plate 2 via a vacuum bag 3. This means that the detonating cord 1 is sealed in a plastics bag, which is in turn attached to the base plate 2. One lap of detonating cord 1 is passed perpendicularly over the flat-wound spiral.

Adhesive strips 5 adhering in the shape of a cross to the detonating cord 1 serve to fix the detonating cord 1 prior to sealing in the vacuum bag 3. The individual laps of the spirally wound detonating cord 1 are arranged at a given spacing from one another, so that, in the event of misfiring of the detonating cord 1, the adjacent lap is destroyed without crossover firing taking place. Crossover firing means that the adjacent lap is ignited and the ignition process passed on to the remaining laps. In FIG. 2, the space is produced by a spacing cord 8 extending in parallel.

Reference numeral 6 indicates the image area of an X-ray installation, wherein the entire detonating cord 1 is advantageously X-rayed at once. The X-ray image is preferably taken at a right angle to the plane of the spiral detonating cord. If a booster is connected to the detonating cord 1, the wad gaps between booster and detonating cord 1 may likewise be inspected by X-ray image.

Figure 1:
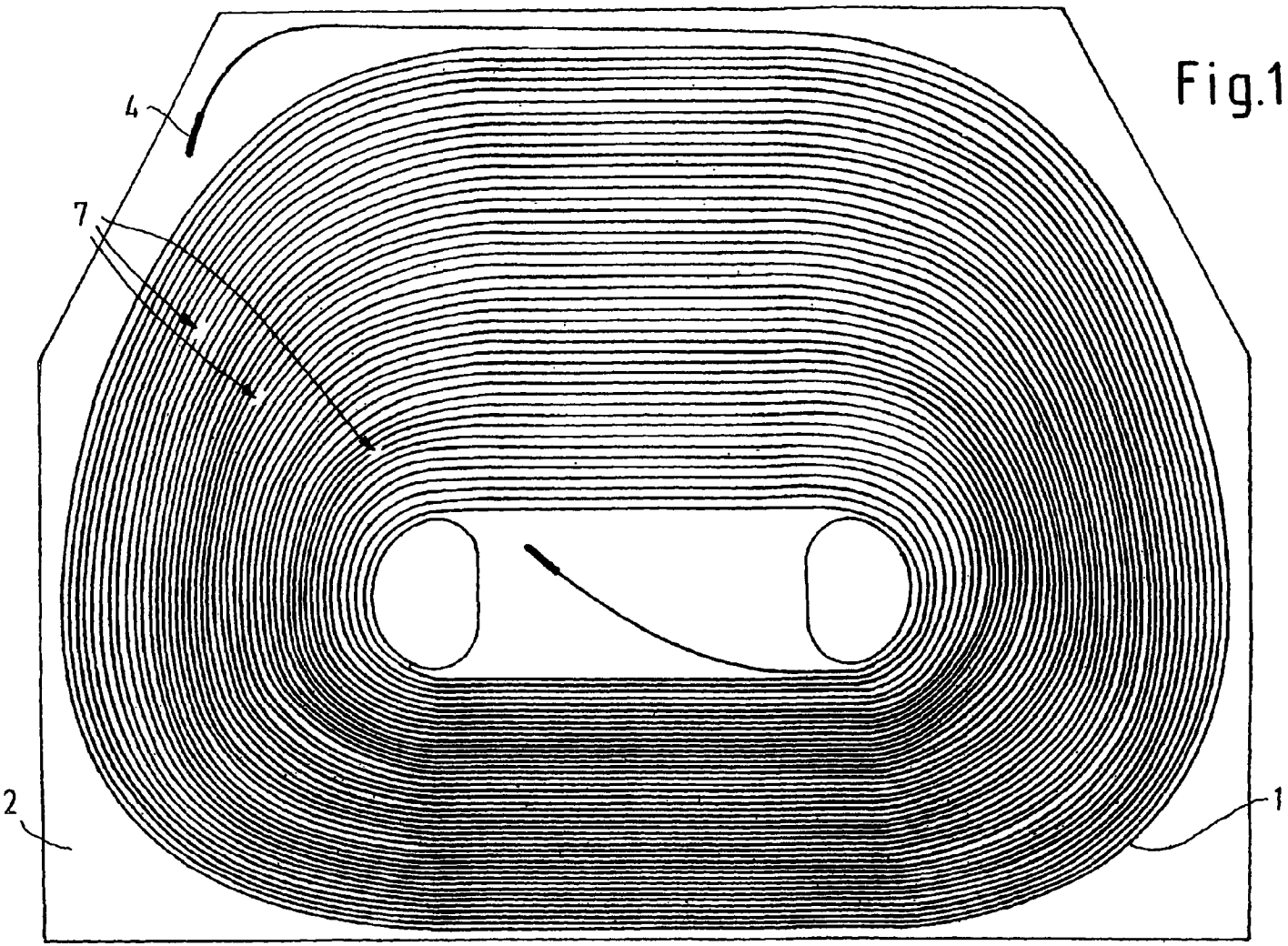
FIG. 1 shows an X-ray image of a spiral detonating cord in its packaging.

FIG. 1 shows such an X-ray image of the spiral detonating cord 1 in its packaging. In this illustrated instance, the detonating cord 1 contains defects 7, however, which would lead to failure of the detonating a cord 1. This defective detonating cord 1 would therefore not be shipped.

The invention claimed is:

1. A method of creating and examining a packaging of a detonating cord, comprising:

winding a detonating cord in a single plane as a flat spiral, wherein a space separating at least two individual laps of the flat spiral is produced by a spacing cord extending in parallel to the detonating cord, and wherein the thickness of the spacing cord corresponds to the space;

subjecting the detonating cord to X-ray examination in its packaging prior to shipping, without unwinding the detonating cord, thereby revealing when the detonating cord contains a defect.

2. The method according to claim 1, further comprising: shipping the packaging containing detonating cord when a result of the X-ray examination does not reveal any defect which would lead to failure of the detonating cord.

3. The method according to claim 2, further comprising:

activating the shipped detonating cord to ignite a shaped charge perforator in a perforating gun.

4. The method according to claim 3, wherein the shaped charge perforator is ignited in the perforating gun during the course of perforating at least one of an oil well and a gas well.

5. The method according to claim 1, wherein the detonating cord is wound on a base plate.

6. The method according to claim 5, wherein the base plate comprises at least one of paperboard, wood and polystyrene.

7. The method according to claim 1, wherein a last lap of the flat spiral is passed perpendicularly over the rest of the flat spiral.

8. The method according to claim 1, wherein the detonating cord is sealed in a vacuum bag; and wherein the vacuum bag is attached to a base plate.

* * * * *